US006149150A

United States Patent [19]

Onipchenko et al.

[11] Patent Number: 6,149,150

[45] Date of Patent: Nov. 21, 2000

[54] BANKNOTE CENTERING DEVICE FOR A VALIDATOR

[75] Inventors: Oleksandr Onipchenko, Kiev, Ukraine; Sergiy Bukman, Toronto, Canada; Vladimir A. Schwartz, Kiev, Ukraine

[73] Assignee: Cashcode Company Inc., Concord

[21] Appl. No.: 09/263,513

[22] Filed: Mar. 5, 1999

[51] Int. Cl.[7] ..... B65H 9/00

[52] U.S. Cl. ..... 271/240; 271/227; 271/265.02

[58] Field of Search ..... 271/227, 240, 271/265.02, 265.01

[56] References Cited

U.S. PATENT DOCUMENTS

| | | | |
|---|---|---|---|
| 4,426,073 | 1/1984 | Mizuma . | |
| 5,091,754 | 2/1992 | Abe et al. | 271/240 |
| 5,140,166 | 8/1992 | Gerlier . | |
| 5,172,138 | 12/1992 | Okazawa et al. | 271/255 |
| 5,332,208 | 7/1994 | Tsuji et al. | 271/240 |
| 5,368,147 | 11/1994 | Menke et al. . | |
| 5,381,021 | 1/1995 | Polidoro . | |

FOREIGN PATENT DOCUMENTS

| | | | |
|---|---|---|---|
| 0117823 | 5/1988 | Japan | 271/240 |
| 0313250 | 12/1989 | Japan | 271/240 |
| 403177245 | 8/1991 | Japan | 271/240 |
| 406048616 | 2/1994 | Japan | 271/240 |

*Primary Examiner*—H. Grant Skaggs

[57] ABSTRACT

A banknote centering device uses a drive arrangement to accelerate two opposed side plates and the inertia of the side plates causes the banknote to be centered. The resistance of the banknote to buckling stops the side plates. A separate drive for the side plates accelerates the side plates and stalls when a banknote is centered. Preferably, the current for the drive of the side plates is variable to adjust for changing conditions.

10 Claims, 5 Drawing Sheets

BANKNOTE CENTERING DEVICE FOR A VALIDATOR

BACKGROUND OF THE INVENTION

The present invention relates to centering devices for banknotes or paper currency designed to center a banknote for processing by a validator or other like device.

Currency validators have proven to be extremely popular for use with vending machines, banking machines and other devices requiring payment. In many situations, the currency validator is designed to receive a banknote of a given width which is longitudinally fed into the currency validator. In some countries and in particular in many European countries, the currency is not of a fixed width and the widths vary considerably. The variable width of the bills create problems as validators are typically designed to screen selected strips of the bills and the position of the bills in the validator can vary dramatically. It is desirable to process banknotes in a similar manner by aligning the center line of the banknote with a common central axis of the validator. In this way, the scanning devices are always consistently located relative to the center line of the currency.

There have been various structures to achieve this centering aspect. One such design has a slot with a number of stepped regions each centered with respect to the center line. In this way, a currency of a narrow width is located in a narrow slot and larger width currency is appropriately placed in a larger slot. With this structure, the user must properly locate the currency for processing. Another example of a centering arrangement is found U.S. Pat. No. 5,368,147. In this device, the currency is fed longitudinally into the centering device and a spring type action is used between two side engaging members to center the currency about a center line of the validator. This device is quite complicated and is difficult to manufacture and the operation thereof is subject to considerable variations.

It is desirable to be able to provide a centering device which is reliable, accurate and easy to manufacture.

SUMMARY OF THE INVENTION

A banknote centering device according to the present invention comprises an enlarged slot for receiving a banknote longitudinally, side engaging members associated with the slot and movable from an open position either side of the slot to a narrow position defining a minimum position between the side engaging members, a banknote drive mechanism for driving a banknote from an insert position to a centering position where the banknote is free to move within the slot, a drive arrangement for moving said side engaging members in a controlled manner towards one another and equally spaced either side of a centerline of said slot, said side engaging member drive arrangement including a motor for accelerating said side engaging members from the open position towards the narrow position until further inward movement of the side engaging members is opposed by the sides of a banknote being parallel therewith and contacting said side engaging members over a substantial length thereof centering the banknote in the slot.

The banknote centering device according to an aspect of the invention has the side engaging members slidably secured on a common shaft and the drive arrangement of said side engaging members is positioned to one side of the common shaft.

According to a further aspect of the invention the drive arrangement of said side engaging members includes a screw drive in drive connection with the side engaging members, the screw drive includes a second shaft parallel to the common shaft. The screw drive maintains the side engaging members appropriately spaced during movement between said open and said narrow position.

According to yet a further aspect of the invention the drive arrangement alternately drives and releases the banknote allowing the banknote to move laterally when released.

According to a further aspect of the invention the drive mechanism includes a drive wheel of a non circular periphery which alternately engages the banknote for driving thereof and releases the banknote for centering thereof.

A banknote centering device, according to the invention, comprises an oversized slot for receiving banknotes longitudinally, side engaging members associated with said slot and movable from an open position either side of said slot to a narrow position defining a minimum spacing between said side engaging members, a drive mechanism for initially driving a banknote from an insert position to a position for centering by movement of said side engaging members in a controlled manner towards one another and thereby center a banknote within said drive, said banknote drive arrangement including a drive member which engages and releases said banknote when moved longitudinally from said insert position to said centered position and releasing said banknote when said banknote is in said centering position, and said side engaging members including a separate drive arrangement for moving said side engaging members, said separate drive arrangement including a motor drive for initially accelerating said side engaging members towards said narrow position unopposed by a banknote to provide sufficient inertia to center a floating banknote between said side members until the movement of said side member is opposed by a resistance of the banknote to buckling which resistance stalls said motor drive.

According to an aspect of the invention, the banknote drive member is a non circular rotatable drive member having drive engaging portions separated by drive release portions, said drive engaging portions driving said banknote and said drive release portions releasing said banknote for lateral movement.

According to a further aspect of the invention the separate drive arrangement of the side members includes a reversible motor which rotates said second shaft in a first direction for movement of the side engaging members towards said narrow position and rotates said second shaft in a second direction, opposite to said first direction, to move said side engaging members to the open position.

BRIEF DESCRIPTION OF THE DRAWINGS

Preferred embodiments of the invention are shown in the drawings wherein.

DETAILED DESCRIPTION ACCORDING TO THE PREFERRED EMBODIMENTS OF THE PRESENT INVENTION

Figure 1:
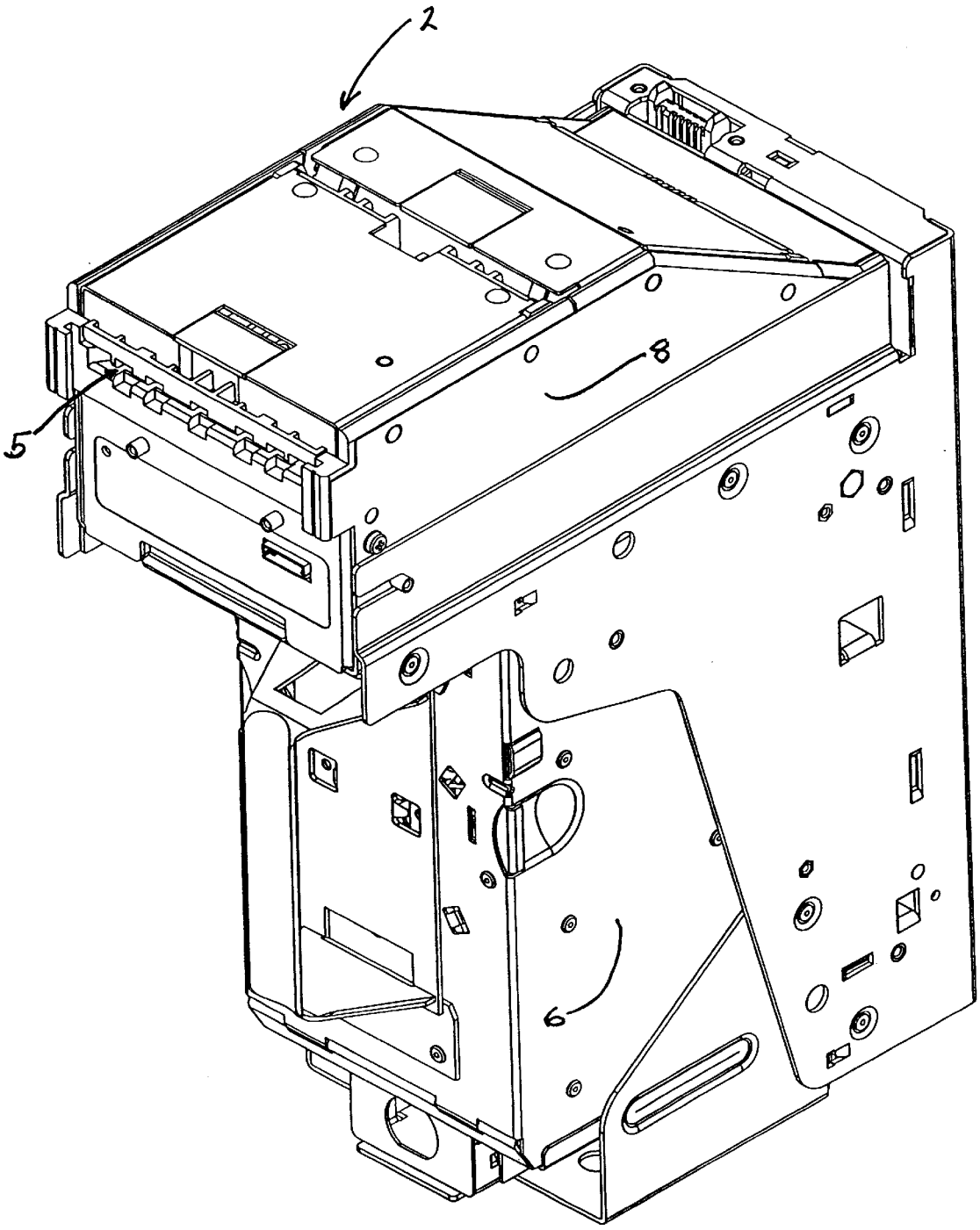
FIG. 1 shows a perspective view of a validator with an integrated banknote centering device at the inlet thereof.
Figure 2:
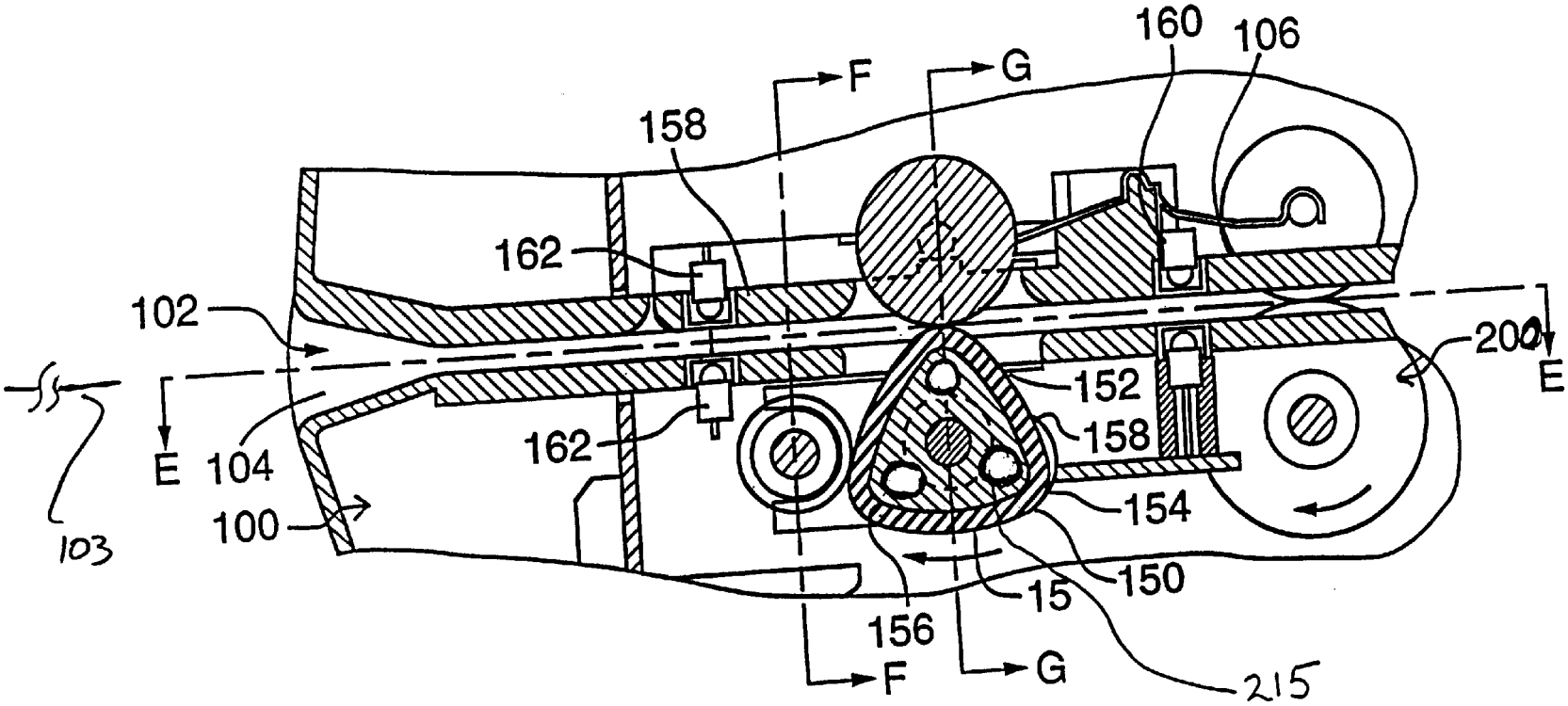
FIG. 2 is a vertical sectional view along the longitudinal axis of the centering arrangement.

The validator 2 as shown in FIG. 1 is designed to receive banknotes of various widths. The inlet slot 5 is sized for receiving the largest width of banknotes and advance the banknote into the validator for centering. The precise location and angle of the banknote when inserted into the validator is not known and the centering arrangement must allow for this design consideration. The centering arrangement is aligned with slot 5 and located within the housing 8.

Once a banknote has been centered it is evaluated as it moves past a series of sensors located in the lower part of housing 8. If the currency is determined to be authentic, the currency is then stored in the stacker box 6. There are various designs of banknote validators which use optical and magnetic scanners for determining whether the bill is authentic and the value thereof. In many countries, banknotes vary considerably in width and banknotes of different currencies are almost always of different widths. The centering device as described herein is integrated into the validator, however it can be designed as a standalone device to be used in cooperation with validators.

Figure 3:
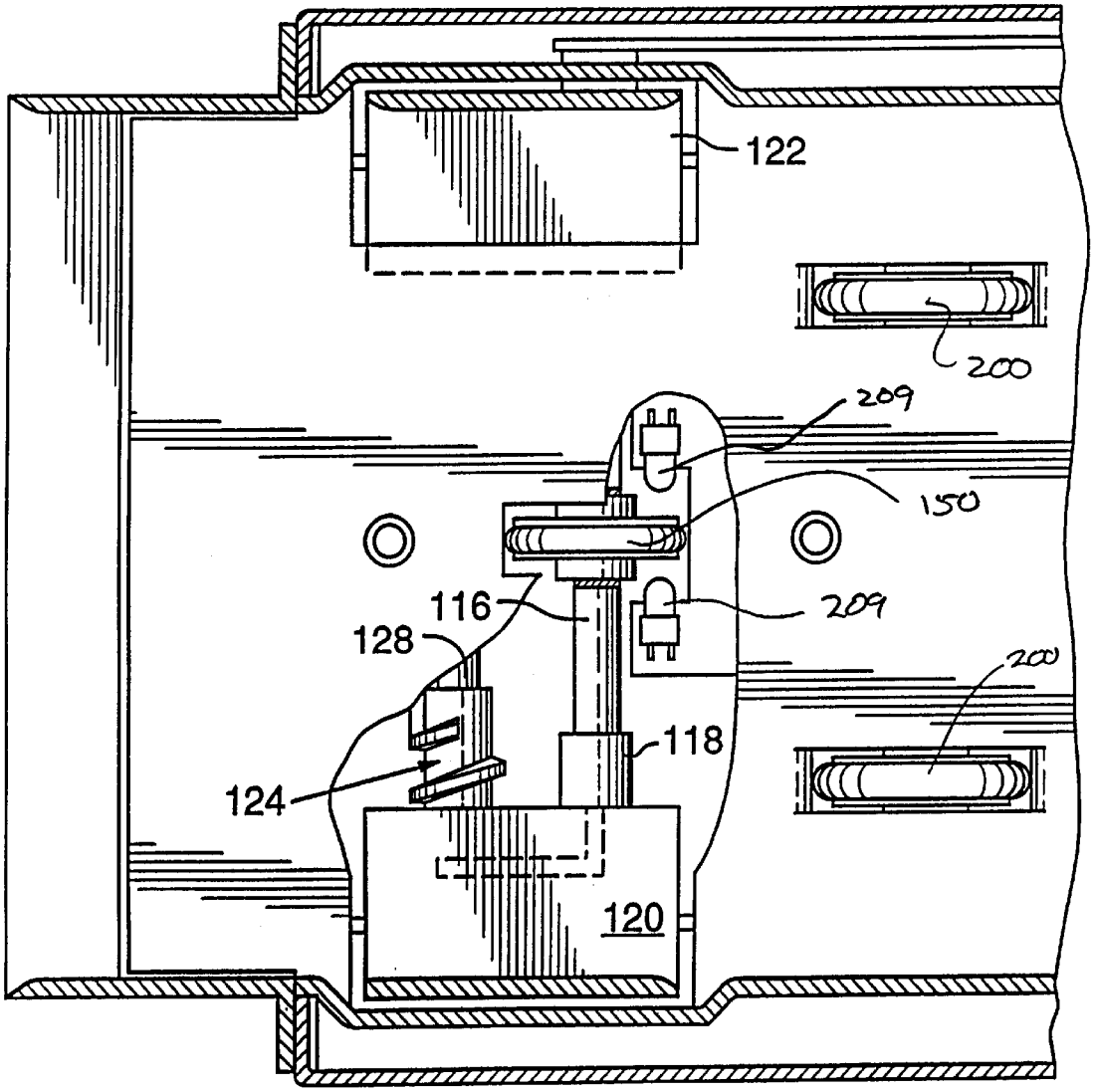
FIG. 3 is a sectional view along line E—E of FIG. 6.
Figure 4:
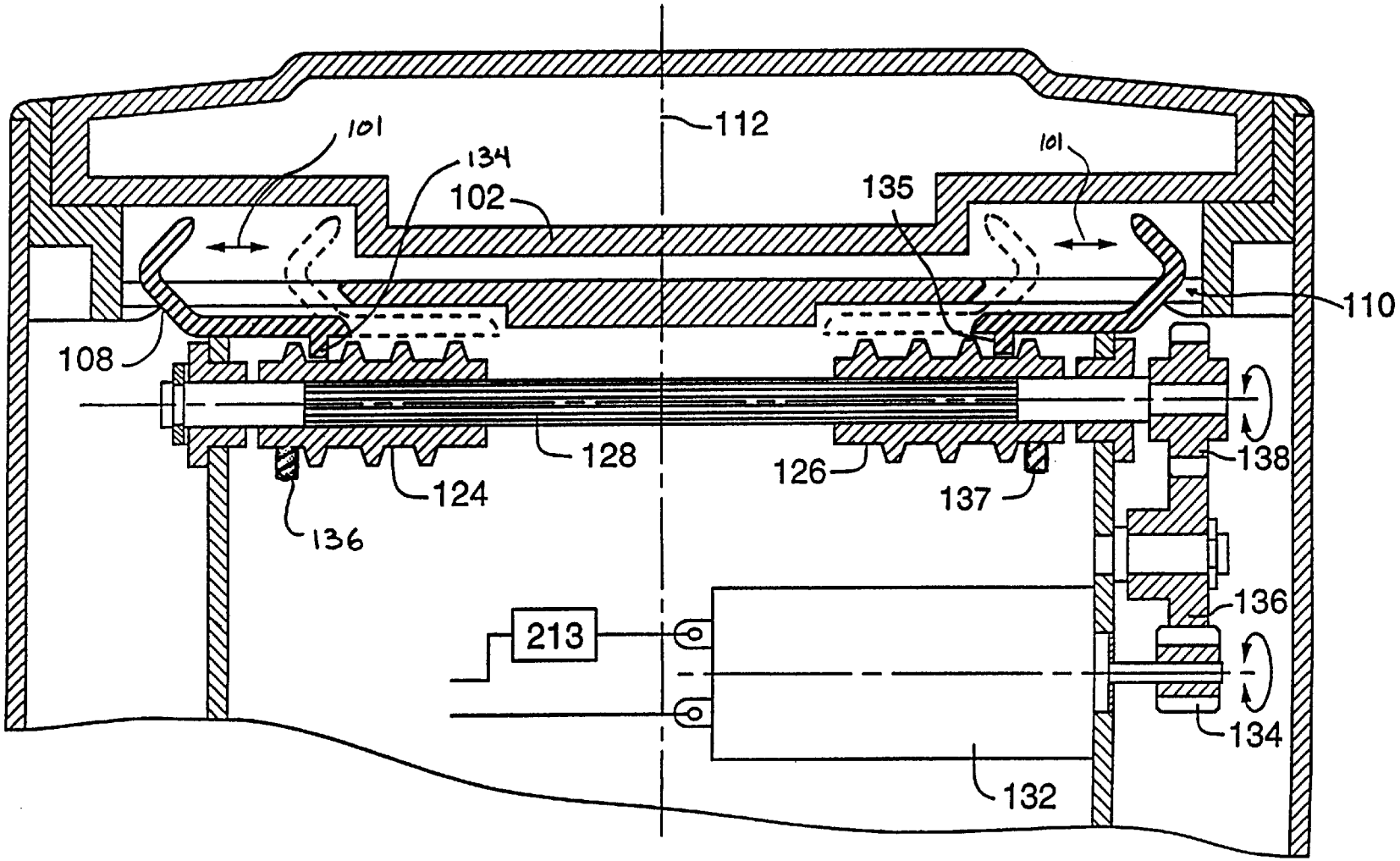
FIG. 4 is a sectional view along line F—F of FIG. 2.

The centering device 100, shown in FIGS. 2, 3, 4 and 5 includes an oversized slot 104 which receives the banknote 103 longitudinally and the center line of the banknote 103 in most cases will not be aligned with the center line of the slot generally indicated as 112 in FIG. 4. In addition the banknote may be angled relative to the longitudinal fed direction of a banknote into the centering device. The centering device pulls the banknote into the particularly and releases the banknote for centering relative to the center line 112.

A banknote is longitudinally inserted by the user into the centering device 100 at oversized slot 104 for movement along the path 102. The user partially inserts the banknote 103 by hand until it is sensed by sensor 162 and until the banknote generally strikes the drive wheel 150. At this point, the drive wheel is activated and engages the banknote causing it to be advanced towards the centering position. The drive wheel 150 due to its shape alternatively drives and releases the banknote, allowing the banknote, during a release position, to float and minor lateral alignment of the banknote in the slot may occur. When the leading edge of the banknote is detected by sensor 160, the position of the drive wheel 150 is watched by sensor 209 (FIG. 3) and the drive wheel is stopped in an angular position where the banknote is floating for centering. Sensor 209 detects one of the position ports 215 located in the drive.

The "V" shaped side engaging members 108 and 110 (FIG. 4) are then moved quickly inwardly to provide an inertia force used to center a banknote, regardless of its width. The floating banknote is centered by the rapid movement of the jaws which stop due to the resistance force of the banknote opposing buckling of the banknote. The centered banknote is then driven through the validator and processed in the normal manner.

The top view of FIG. 3 and sectional view of FIG. 4 show the details of the centering mechanism and illustrate how the centering of the banknote is accomplished. 'V' shaped side engaging members 108 and 110 are driven in a controlled manner from the fully open position of FIGS. 3 and 4 to a narrow position shown in dotted lines in FIG. 4. The movement of these members is indicated by the arrow 101. The side members move together and are equally spaced either side of the center line 112. Each of the side engaging members 108 and 110 includes a bearing portion 118 which freely slides on the first shaft 116 while allowing shaft 116 to rotate. This shaft drives the drive wheel 150 which engages the banknote when it is inserted into the slot 104 of the centering device, drives it into the centering device and then releases the banknote for centering at 106.

As shown in FIG. 4, the V-shaped side engaging members 108 and 110 are moved inwardly such that the width of the path 102 is rapidly narrowed for centering a received banknote relative to the center line 112.

The V-shaped members 108 and 110 slide on shaft 116 as shown in FIG. 3. Drive wheel 150 is splined to the shaft 116 and is fixed thereon. With this arrangement, shaft 116 can rotate causing drive wheel 150 to rotate while the shaft merely rotates in the bearing 118 of the side engaging members 108 and 110. The side engaging members 108 and 110 are driven by the screw thread drives 124 and 126 carried on adjacent parallel shaft 128 (see FIG. 3). The screw thread drives 124 and 126 are splined to shaft 128 and cause the side engaging members 108 and 110 to either move outwardly or inwardly as shown by the doubled-sided arrow 101 in FIG. 4.

Figure 5:
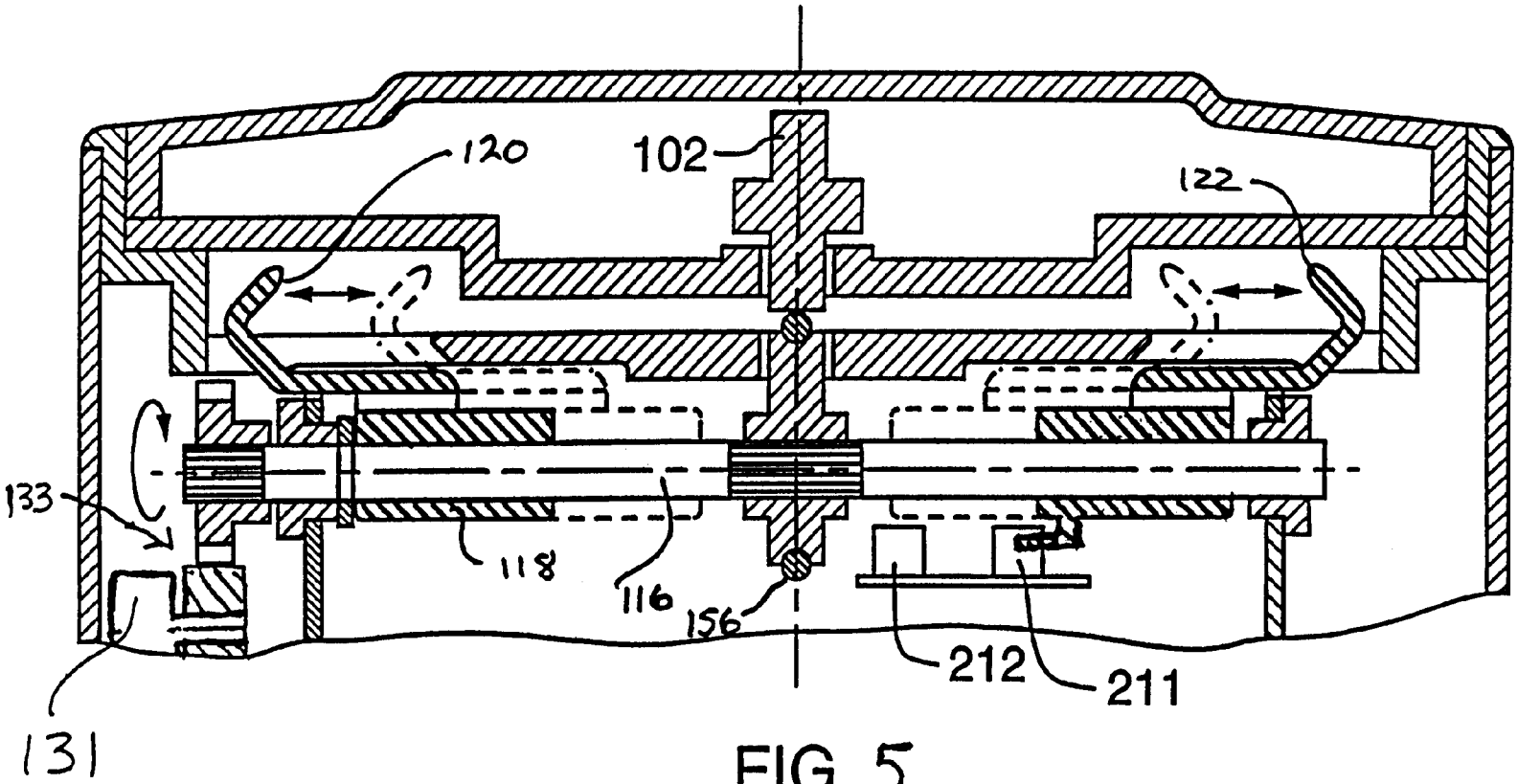
FIG. 5 is a sectional view along line G—G of FIG. 2.

With reference to FIG. 5, position sensors 211 and 212 sense the two end positions of the side engaging member. Sensor 213 measures the time required to complete a complete cycle of the side engaging members and allows adjustment of the current to achieve a desired cycle time.

With the side engaging members in the outer most position, the motor is switched on and a relatively high initial current draw occurs to start the motor and begin movement of the components. The current is then limited by sensor 213 to a lower run current. The side engaging members are in a clear position beyond the sides of the banknote and rapidly accelerate to gain momentum for centering of a banknote. Basically, the momentum of the side engaging members provides the energy to appropriately center the free floating bill. The run current setting for the motor is insufficient to move the side engaging members from rest once they have struck the banknote. Therefore for each cycle of the side engaging members the side engaging members are brought up to speed and continue to be driven until such time as the banknote provides a resisting force due to the resistance of the banknote to buckling. Basically, the side engaging members are accelerated and continue to be driven until the banknote is struck. The inertia of the side engaging members and the power due to the run current cause the side engaging members to move the banknote and center the free floating banknote between the side engaging members. Once centered, the banknote resists and stops further inward movement of the side engaging members.

The side engaging members are driven quickly and the time for movement of the side engaging members between the open position and the narrow end position if no banknote is present is approximately 0.5 seconds. This rapid movement of the side engaging members provides a two sided one time hammer-like capability used to center the banknote.

The side engaging members are stopped by a centered banknote and the separate motor drive 132 of the side engaging members stalls. The centered banknote is then driven by drive wheel 200 into the validator for further processing. Once the banknote is advanced into the validator, i.e. it has cleared the centering device, the drive motor of the side engaging members is restarted to complete its cycle and return the members to the fully open position. Position sensors 211 and 212 confirm the end positions.

The centering device from time to time cycles through a number of side engaging members movements without a banknote present. Sensor 213 times the cycle and compares the timed cycle with a reference cycle time. Sensor 213 then adjusts the run current setting to achieve a desired cycle time such that a desired speed and inertia are provided by the side engaging members for centering a banknote.

This current draw sensing arrangement requires adjustment from time to time to take into account changing conditions such as dirt and/or wear, which can change the run current draw required to appropriately move the members 108 and 110. It is also important not to set too high a run current draw, as buckling of the bill could occur. This changing condition over time is compensated for by cycling the centering mechanism from time to time without a banknote present. In this way, the current can be adjusted to achieve a desired cycle time from the open position to the narrow position. The initiation of this testing process can occur based on other operating features of the validator. For example, the validator can sense when a cassette used to stack banknotes is removed and the insertion of a new cassette triggers the device to cycle the centering mechanism without a bill being present a number of times and the run current is appropriately adjusted if necessary to achieve the desired cycle time. Other arrangements or trigger mechanisms can also be used.

Shaft 128 as shown in FIG. 4 has its own motor 132 and drive train comprising gears 134, 136, and 138. The motor and drive train stall due to the resistance of a centered banknote. Once a banknote clears the centering mechanism, the motor cycles the side members to move them to the open position. The intermittent driving of a banknote through the centering mechanism simplifies floating of a banknote once it has reached a desired position. A triangular like drive member uses the apexes of the triangle to move a banknote and releases the banknote between the apexes. A sensing arrangement 209 can determine when a banknote is released by sensing the position of the triangular drive. Therefore, for each rotation of the triangular member, three release positions occur. Other shaped drive members can be used to achieve this alternating drive release feature.

The first gear 134 is driven by the motor 132 and is in drive relation with gear 136 which rotates gear 138 causing rotation of shaft 128. With this rotation, the screw thread drives 124 and 126 rotate with shaft 128. Side engaging members 108 and 110 include lugs 134, 136 and 135, 137, which move along the screw drive members 124 and 126. This causes the desired movement of the side engaging members 108 and 110.

A separate motor 131 powers a fixed drive train 133 associated with shaft 116. The non circular drive wheel 150 includes three corner engaging portions 152, 154 and 156 distributed about the drive wheel and non engaging portions 158 located between the engaging portions. The engaging portions drive the banknote towards the centered position 106, however, the amount of drive for each engaging portion is relatively small followed by release of the banknote. In these release positions, a banknote floats and some partial alignment may occur. The wheel 150 continues to move the banknote towards the centering position until it is sensed by sensor 160. During the process from the initial position at 104 to the center position at 106, the drive wheel is rotated a number of times and the banknote has not yet been centered. The design is such that the V-shaped side engaging members move towards their narrow position shown in dotted lines in FIG. 8, from their outer most position quickly, to effect centering. The movement of the jaws is opposed when the banknote has been centered around center line 112 due to the resistance of the banknote to buckling. This resistance is increased due to the support of the banknote within the centering device.

Once the banknote has cleared the centering device, the centering device will cause motor 132 to cycle and move the side engaging members outwardly until they reach their outermost position which is sensed by detector 211.

With the arrangement shown in FIGS. 1 through 5, a relatively simple drive arrangement is used to move a banknote from an insert position to a validator processing initial position at which time the banknote is released for centering. The drive arrangement has a shaped drive wheel which causes an initial drive followed by a release, followed by a further drive, etc., and some rough centering is accomplished during the release portion.

The banknote is finally advanced to a centering position where the side engaging members are moved rapidly inwardly to achieve centering of the banknote. The centered banknote is then advanced into the validator and the centering device returns the jaws to the open position for receipt of a new banknote. A monitoring arrangement tests the centering device from time to time and adjusts the drive arrangement of the jaws to compensate for changing conditions.

Although various preferred embodiments of the present invention have been described in detail, it will be understood by those skilled in the art, that variations may be made thereto without departing from the spirit of the invention or the scope of the appended claims.

The embodiments of the invention in which an exclusive property or privilege is claimed are defined as follows:

1. A banknote centering device comprising an enlarged slot for receiving a banknote longitudinally, side engaging members associated with said slot and movable from an open position either side of said slot to a narrow position defining a minimum position between said side engaging members, a banknote drive mechanism for driving a banknote from an insert position to a centering position where the banknote is freely centered within said slot, a side engaging members drive arrangement for moving said side engaging members in a controlled manner towards one another and equally spaced either side of a centerline of said slot, said side engaging member drive arrangement including a motor for accelerating said side engaging members from said open position towards said narrow position until further inward movement of said side engaging members is opposed by the sides of a banknote being parallel therewith and contacting said side engaging members over a substantial length thereof centering the banknote in the slot, said side engaging members being slidable along a common shaft and said drive arrangement of said side engaging members is positioned to one side of said common shaft; and wherein said drive arrangement of said side engaging members includes a screw drive in drive connection with said side engaging members, said screw drive including a second shaft parallel to said common shaft, said screw drive maintaining said side engaging members appropriately spaced during movement between said open and said narrow position.

2. A banknote centering device as claimed in claim 1 wherein said drive arrangement intermittently drives and releases the banknote allowing the banknote to move laterally when released, and then re-engages and advances the bill.

3. A banknote centering device as claimed in claim 2 wherein said drive mechanism includes a drive wheel of a non circular periphery which alternately engages the banknote for driving thereof and releases the banknote for centering thereof.

4. A banknote centering device as claimed in claim 1 wherein said separate drive arrangement of said engaging members includes a reversible motor which rotates said second shaft in a direction dependent upon the direction of rotation of said reversible motor.

5. A banknote centering device comprising an oversized slot for receiving banknotes longitudinally, side engaging members associated with said slot and movable from an open position either side of said slot to a narrow position defining a minimum spacing between said side engaging members, a drive mechanism for initially driving a banknote from an insert position to a position for centering by movement of said side engaging members in a controlled manner towards one another and thereby center a banknote within said drive, said banknote drive arrangement including a drive member which engages and releases said banknote when moved longitudinally from said insert position to said centered position and releasing said banknote when said banknote is in said centering position, and said side engaging members including a separate drive arrangement for moving said side engaging members, said separate drive arrangement including a motor drive for initially accelerating said side engaging members towards said narrow position unopposed by a banknote to provide sufficient inertia of said engaging members to center a floating banknote between said side engaging members until the movement of said side members is opposed by a resistance of a banknote to buckling sufficient to stall said motor drive.

6. A banknote centering device as claimed in claim 5 wherein said side engaging members are driven by a screw drive arrangement.

7. A banknote centering device as claimed in claim 5 wherein said banknote drive member is a non circular drive wheel having drive engaging portions and drive release portions which alternate, said drive engaging portions driving said banknote and said drive release portions releasing said banknote for lateral movement.

8. A banknote centering device comprising an enlarged slot for receiving a banknote longitudinally, side engaging members associated with said slot and movable from an open either side of said slot to a narrow position defining a minimum position between said side engaging members, a banknote drive mechanism for driving a banknote from an insert position to a centering position where the banknote is freely centered within said slot, a side engaging members drive arrangement for moving said side engaging members in a controlled manner towards one another and equally spaced either side of a centerline of said slot, said side engaging member drive arrangement including a motor for accelerating said side engaging members from said open position towards said narrow position until further inward movement of said side engaging members is opposed by the sides of a banknote being parallel therewith and contacting said side engaging members over a substantial length thereof centering the banknote in the slot, and including a current setting level circuitry for controlling the power of said motor for said drive arrangement, said current setting level circuitry adjusting the current level based on cycle times of said side engaging members between fully open to said narrow position and back to said fully open position without a banknote present.

9. A banknote centering device as claimed in claim 8 wherein said circuitry adjusts the current to maintain a predetermined cycle time.

10. A banknote centering device as claimed in claim 9 wherein said circuitry causes said centering mechanism to cycle for setting said current at certain time intervals and thereby adjusts to changing conditions.

* * * * *